US007800318B2

(12) United States Patent
Hsu

(10) Patent No.: US 7,800,318 B2
(45) Date of Patent: Sep. 21, 2010

(54) POWER SUPPLY DEVICE FOR A LCD BACKLIGHT PANEL

(75) Inventor: Da-Jing Hsu, Sijhih (TW)

(73) Assignee: Niko Semiconductor Co., Ltd., Sijhih, Taipei County (TW)

( * ) Notice: Subject to any disclaimer, the term of this patent is extended or adjusted under 35 U.S.C. 154(b) by 1114 days.

(21) Appl. No.: 11/478,663

(22) Filed: Jul. 3, 2006

(65) Prior Publication Data

US 2007/0171181 A1 Jul. 26, 2007

(30) Foreign Application Priority Data

Jan. 20, 2006 (TW) ..... 95102311 A

(51) Int. Cl.
*G05F 1/00* (2006.01)

(52) U.S. Cl. ..... 315/308; 315/291; 315/274; 315/282; 315/312

(58) Field of Classification Search ..... 315/291–311, 315/312–324, 224, 225, 247, 246, 274–288
See application file for complete search history.

(56) References Cited

U.S. PATENT DOCUMENTS 7,227,316 B2 * 6/2007 Lu ..... 315/308

* cited by examiner

*Primary Examiner*—Tuyet Vo
(74) *Attorney, Agent, or Firm*—Birch, Stewart, Kolasch & Birch, LLP

(57) ABSTRACT

The present invention provides an improved power supply circuit for a backlight control of the LCD panel, capable of initiating a plurality of CCFL. The electrical lighting device comprises an switching electronic ballast circuit, a CCFL abnormal detective circuit, an impedance matching device at positive end of balancing current, an adjusting and enabling control device and an auxiliary power source circuit. The circuit of the electrical lighting device is designed to protect the circuit from abnormal conditions such as short-circuit occurred on a seal cover. The impedance matching device at positive end is provided in between negative ends of some cold cathode fluorescence lamps and an anode of secondary winding of the transformer to balance the CCFL current. Detective units and signals are provided to detect anode voltage in order to determine abnormality in the circuit.

8 Claims, 6 Drawing Sheets

POWER SUPPLY DEVICE FOR A LCD BACKLIGHT PANEL

FIELD OF INVENTION

The present invention relates to a power supply device for a backlight panel of liquid crystal display (LCD). More particularly, the present invention relates to a power supply with a design of current balancing and functions for testing the abnormalities of cold cathode fluorescence lamps (CCFL) and adjusting the intensity thereof.

Description of the Related Art

In the backlight power supply of a liquid crystal display (LCD) a high frequency sine wave is utilized as the power source to provide the energy needed for driving cold cathode fluorescence lamps (CCFL). Thus, the conventional method utilizes normally an inverter circuit to transform the direct current (DC) into the alternate current (AC) in order to achieve the energy transfer. Those conventional inverter circuits are categorized into half-bridge inverter circuits, full-bridge inverter circuits and push-pull inverter circuits according to the circuit topologies.

Further, the alternate current power of the conventional method has to be converted into direct current power of low voltage. A conventional inverter circuit is then utilized to convert the direct current power of low voltage into alternate current power of high frequency and high voltage for driving the cold cathode fluorescence lamps. The energy conversion of the conventional method has to be carried out twice, which would result energy loss twice and therefore an overall conversion efficiency is reduced. For example, the efficiency of an AC/DC adapter is approximately 90%, the efficiency of an inverter converting the direct current into the alternate current is about 85%, and the overall efficiency that is the product of the these two efficiencies is approximately 76.5%.

FIG. 1 shows a schematic diagram of the power supply circuit of high efficiency in a conventional LCD panel. The conventional power supply circuit utilizes a conventional switching electronic ballast circuit of high efficiency, wherein a detective circuit of CCFL abnormality, an impedance matching element at the positive end of CCFL for balancing the current, a delay circuit apparatus and an auxiliary power circuit are also provided in the power supply circuit. The overall efficiency of the structure can reach up to 85% because the energy conversion is performed for only once. But, utilization of optical coupler as a detective device for abnormality can result significantly changes of the current transfer ratio(CTR), which is approximately between 50-400. Such a large range of the CTR could lead to faulty performance. A variable resistor is needed to prevent faulty functions from occurring. Simultaneously, optical couplers as many as the CCFL must be used. Therefore, a large portion of the electrical circuit area would be used for the safety requirements. Since this circuit does not provide the function of adjusting light intensity, it cannot fulfill the basic requirement for a power supply of LCD backlight.

Refer to FIG. 1, the conventional circuit includes a switching electronic ballast circuit 100, a CCFL abnormal detective circuit 201, an impedance matching device at positive end 202 for balancing current, a delay circuit 102 and an auxiliary power circuit 101. The switching electronic ballast circuit 100 produces high frequency alternate sine wave voltage by utilizing the circuit oscillation of the switching circuit SC of a half-bridge or full-bridge topology inverter circuit. The alternate sine wave voltage is converted to the secondary side of the transformer T1 according to the turn ratio to produce the high frequency alternate wave voltage which is required by CCFL LAMP1-LAMPn, in order to supply the energy to the CCFL group 200. In the CCFL abnormal detective circuit 201, the photodiode of each optical couplers PH1-PHn, is respectively connected to the positive end of each of the lamps LAMP1-LAMPn.

The CCFL abnormal detective circuit 201 detects the abnormality of every lamp LAMP1-LAMPn by using the optical couplers PH1-PHn, which send signals when the voltage is detected. The transistors connected in series output these signals to operational amplifiers OP1 and OP2. If there is abnormal high voltage or abnormal low voltage, two high voltage are produced as the outputs of the operational amplifiers OP1 and OP2, and the outputs of operational amplifiers OP1 and OP2 are respectively connected to diodes D1 and D2. The negative ends of the two diodes D1 and D2 are connected. Therefore, no matter whether the detected voltage through the operational amplifiers OP1 and OP2 is the abnormal high voltage or the abnormal low voltage, an abnormal signal is produced to the switching electronic ballast circuit 100, so that the silicon controlled rectifier (SCR) can be locked off and the operation of the switching electronic ballast circuit 100 will be stopped. In order to activate the switching electronic ballast circuit 100 again, the power has to be re-switched on.

Small capacitors C1-Cn are used and connected to the positive end of every lamp LAMP1-LAMPn in parallel in the impedance matching element at the positive end of CCFL 202 for balancing the current. This is because that the small capacitors C1-Cn will produce impedance which is much higher than the lamps LAMP1-LAMPn at higher frequency. The problem of unbalance current resulting from unequalled impedance at positive and negative ends of lamps LAMP1-LAMPn can be improved. The delay circuit apparatus 102 is used to prevent a light off problem of the lamps from occurring due to a faulty operation by temporarily interrupting the outputting of the abnormal signal output during the initiation and the switch on periods. The auxiliary power circuit 101 produces a stable direct current voltage to supply the power source voltage required by the delay circuit apparatus 102 and the CCFL abnormal detective circuit 201.

SUMMARY OF THE INVENTION

It is an object of the present invention to provide a power supply device for a LCD backlight panel to resolve the above-mentioned defaults of the conventional circuit. The power supply device for a LCD backlight panel, capable of driving a plurality of cold cathode fluorescence lamps, comprising a switching electronic ballast circuit, a CCFL abnormal detective circuit, an impedance resistant matching device at positive end of balancing current, an adjusting and enabling control device and an auxiliary power source circuit.

The switching electronic ballast circuit utilizes primary sine wave voltage produced by a switching modulation circuit to provide the primary sine wave voltage via an output of a transformer. The impedance matching device at positive end is provided in between positive ends of each of the cold cathode fluorescence lamps and a positive end of secondary winding of the transformer for balancing the CCFL current. The CCFL abnormal detective circuit comprises a detective unit respectively on every CCFL, wherein the detective unit comprises a voltage detective capacitor and a delay capacitor, every voltage detective capacitor is connected to the corresponding positive end of CCFL to detect positive end voltage of CCFL, one end of the delay capacitor is connected to ground so that it can be charged or discharged through the positive end voltage, a first optical coupler of the CCFL abnormal detective circuit outputs a detective signal according to the positive end voltage to switch on or off the switching electronic ballast circuit.

The adjusting and enabling control device produces an enabling signal to the switching electronic ballast circuit according to a low frequency signal for adjusting pulse wave width. The signal is used to control the operation timing of the switching electronic ballast circuit. The auxiliary power source circuit can provide a stable direct current voltage to the CCFL abnormal detective circuit.

BRIEF DESCRIPTION OF THE DRAWINGS

The accompanying drawings are included to provide a further understanding of the present invention, and are incorporated in and constitute a part of this specification. The drawings illustrate embodiments of the invention and, together with the descriptions, serve to explain the principles of the invention. In the drawings.

DETAILED DESCRIPTION OF THE PREFERRED EMBODIMENTS

Figure 1:
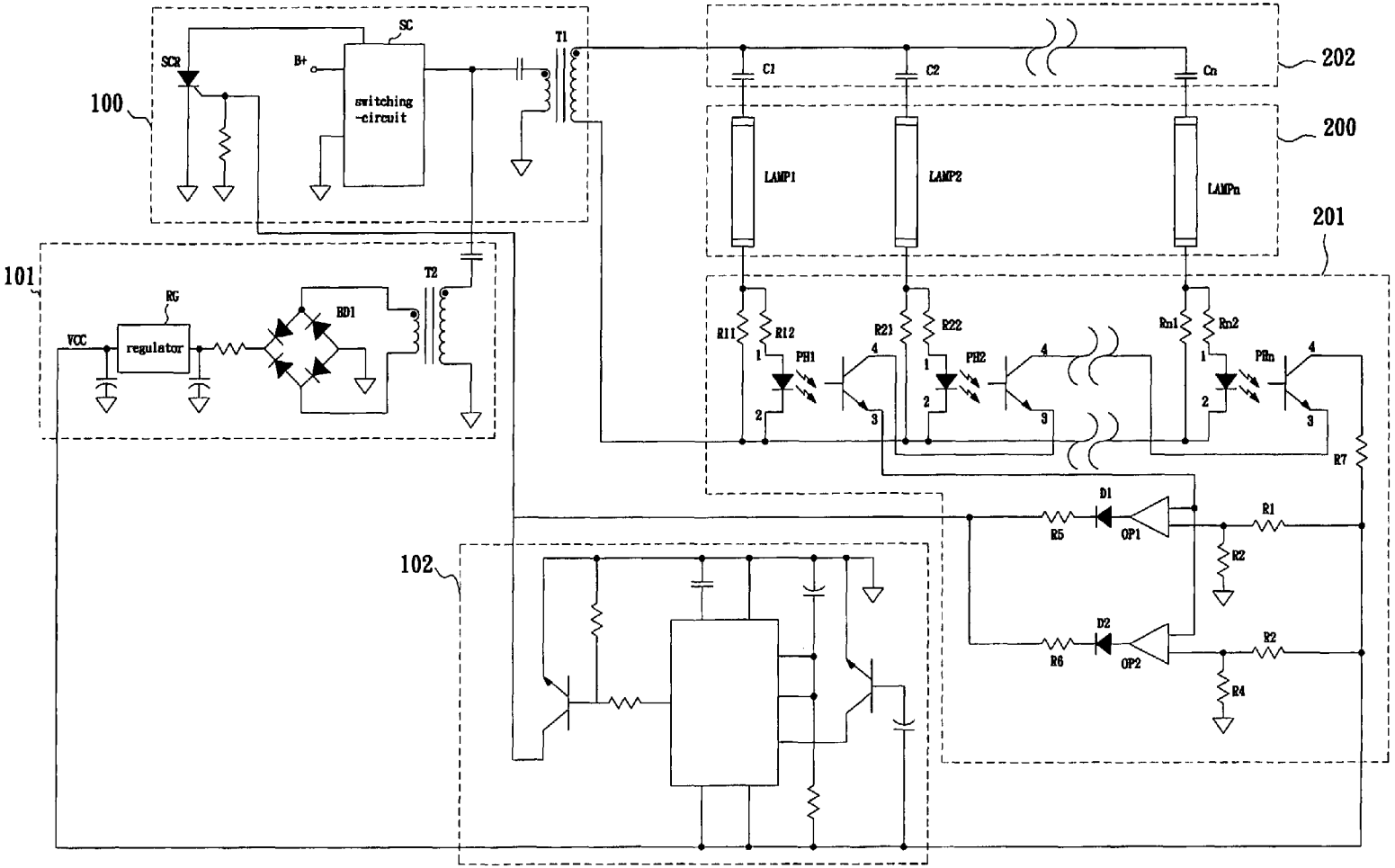
(PRIOR ART) Fig. 1
FIG. 1 shows a power supply circuit in a conventional LCD panel.
Figure 2:
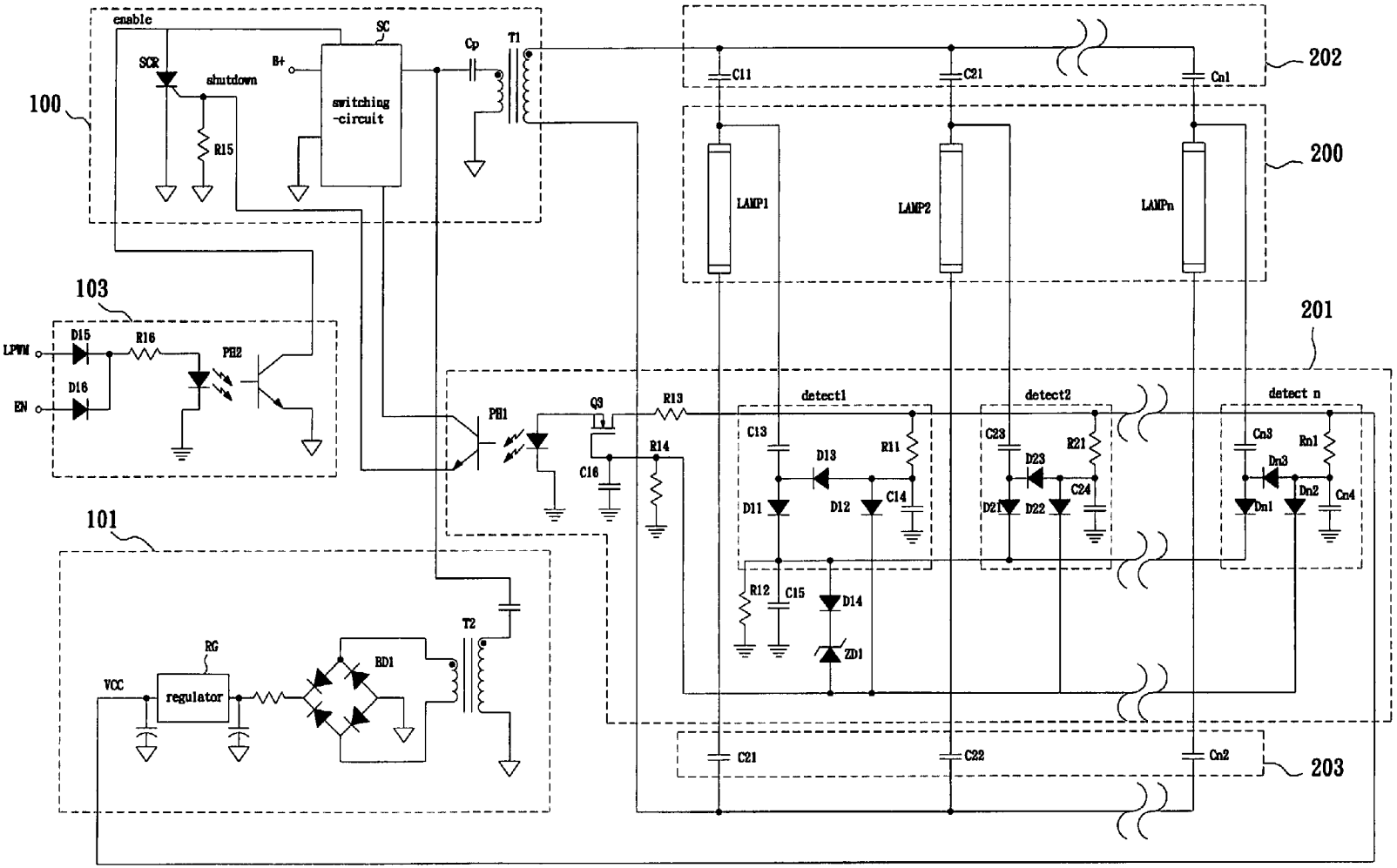
FIG. 2 is a schematic view of an improved power supply circuit of a LCD panel in accordance with a preferred example of the present invention.

FIG. 2 shows a schematic view of an improved power supply circuit of a LCD panel in accordance with a preferred example of the present invention. The power supply circuit of a LCD panel comprises a switching electronic ballast circuit 100, wherein switch circuit SC of half bridge or full bridge topology is provided on the switching electronic ballast circuit 100 and through the resonant circuit to produce alternate sine wave voltage of high frequency. A transformer T1 will convert the alternate sine wave voltage to the secondary of the transformer T1 to output the alternate sine wave voltage with high frequency required by CCFL, LAMP1-LAMPn in order to supply the energy to the CCFL 200. The CCFL abnormal detective circuit 201 detects abnormality of every CCFL, LAMP1-LAMPn.

An impedance matching device at positive end 202 is utilized to balance current, and an impedance matching device at negative end 203 can be provided on the circuit to balance current in order to balance the current of every CCFL, LAMP1-LAMPn within a required range. An adjusting and enabling control device 103 controls periodic operations of the switching electronic ballast circuit 100 via a low frequency adjustable signal LPWM such that the brightness and the timing and order of the operations of the CCFL, LAMP1-LAMPn can be controlled. The auxiliary power circuit 101 produces a stable voltage of direct current for providing the required power source to the CCFL abnormal detective circuit 201.

Figure 3:
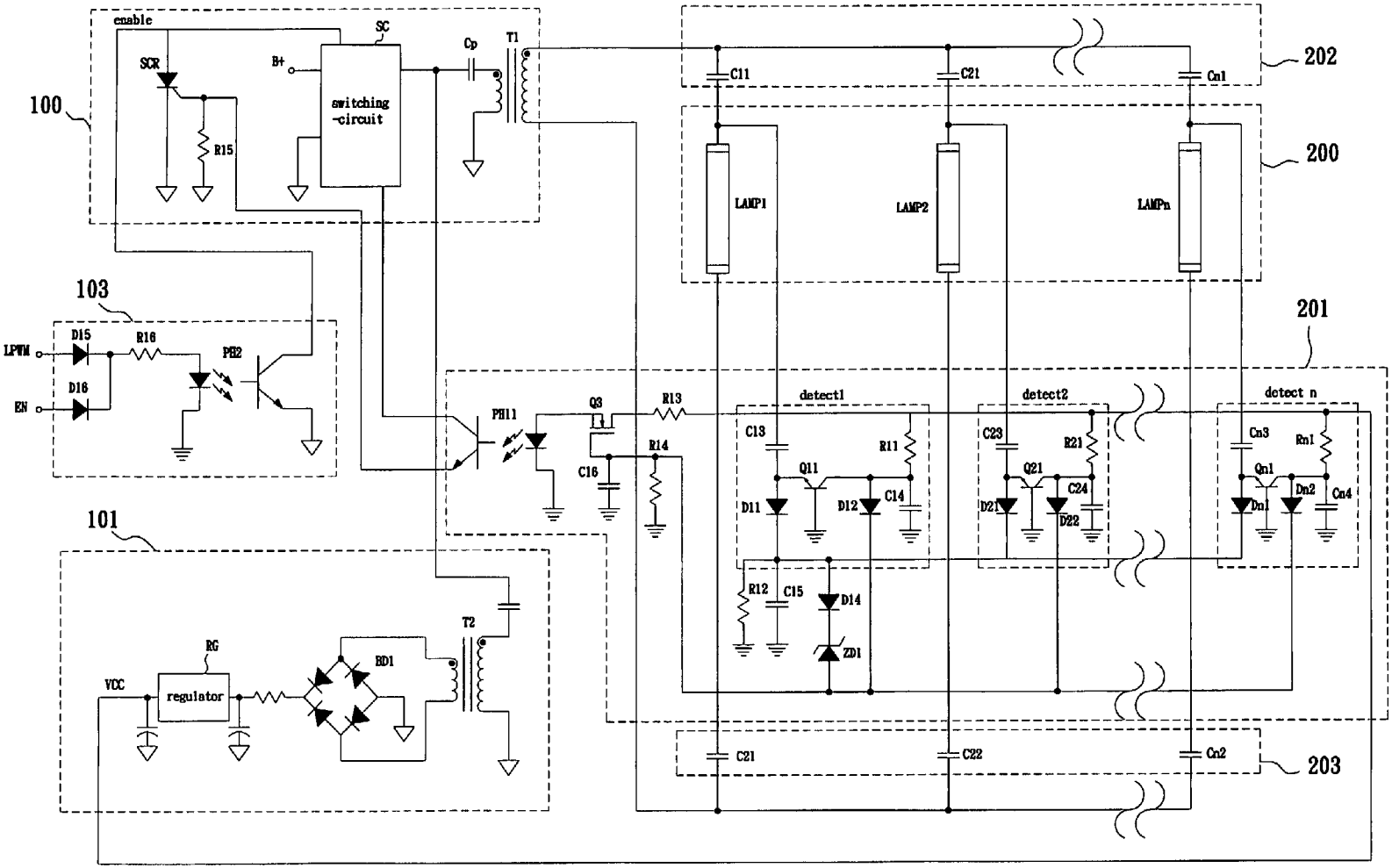
FIG. 3 is a schematic view of an improved power supply circuit of a LCD panel in accordance with another preferred example of the present invention.

FIG. 3 indicates schematic view of the improved power supply circuit of a LCD panel in accordance with another preferred example of the present invention. The CCFL abnormal detective circuit 201 of the circuit in FIG. 3 replaces the diodes D13-Dn3 of FIG. 2 with transistors, Q11-Qn1 to achieve the same effect. When the output of the transformer T1 is at the positive period, voltage detective capacitors, C13-Cn3, operate equivalent functions as the above-mentioned circuit in FIG. 2. When the output of the transformer T1 transfers to the negative direction period, the transistors Q11-Qn1 will be switched on, and the voltage detective capacitors C13-Cn3 discharge and reversed direction charge through the route of the emitter and the collector of the transistors Q11-Qn1. Other operations of circuit in FIG. 3 are identical to those functions of the device's circuit in FIG. 2.

Figure 4:
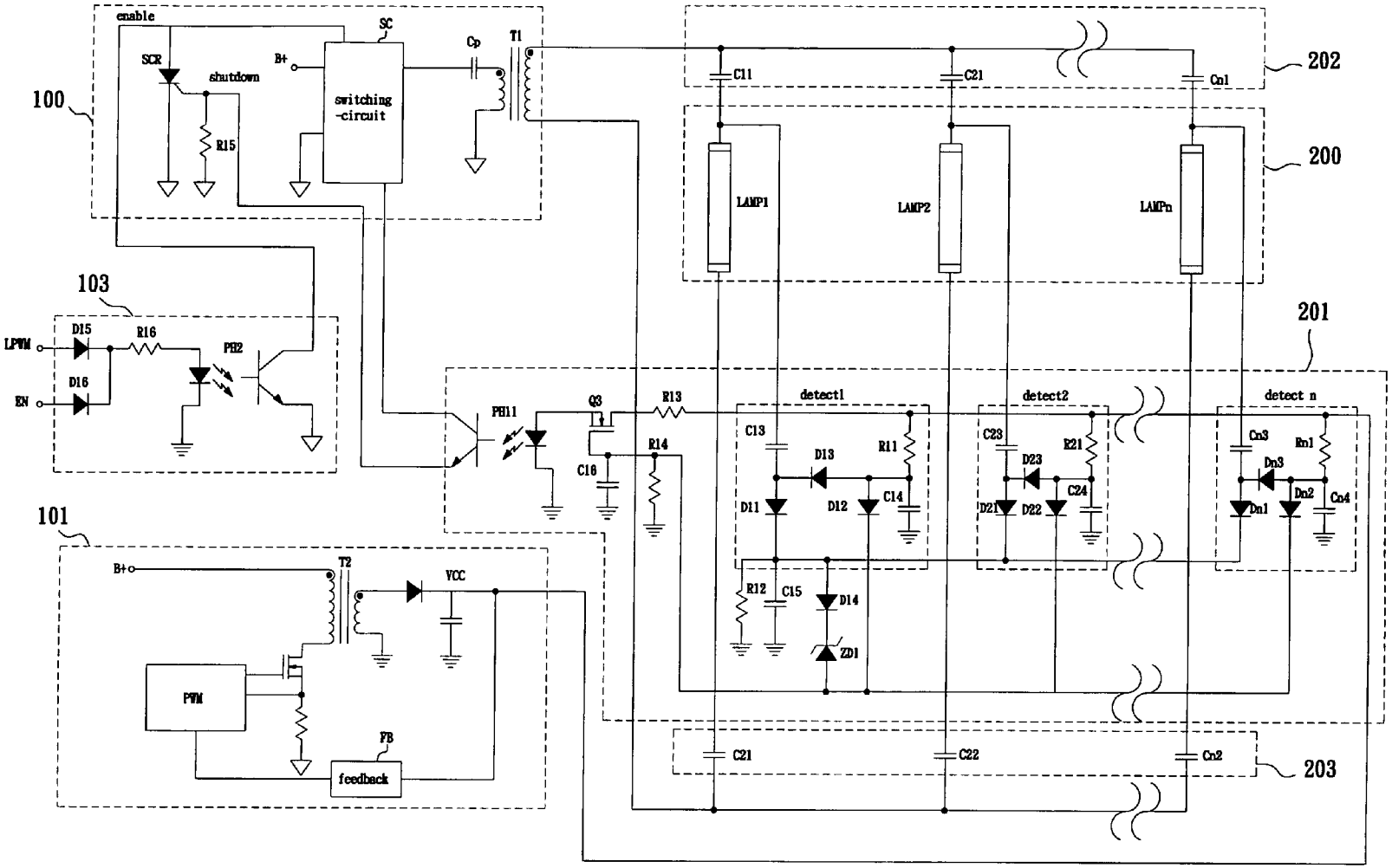
FIG. 4 illustrates a schematic view of an improved power supply circuit of a LCD panel in accordance with other preferred example of the present invention.

Refer back to FIG. 2, the auxiliary power circuit 101 can produce a stabilized direct current voltage VCC to provide power source required by the CCFL abnormal detective circuit 201. FIG. 4 shows schematic view of the improved power supply circuit of a LCD panel in special condition according to another example of the present invention. The auxiliary power circuit 101 can be another switching direct current power circuit of the fly-back switching power circuit. No matter whether it is a LCD television or a display product, direct current power source is required to supply the power to other devices. The auxiliary power circuit 101 of the present invention can directly obtain the power from the power source circuit, such as the auxiliary voltage B+ can be shared as direct power source with other devices in order to cut down the cost of the overall power consumption and the surface area of the circuit.

Figure 5:
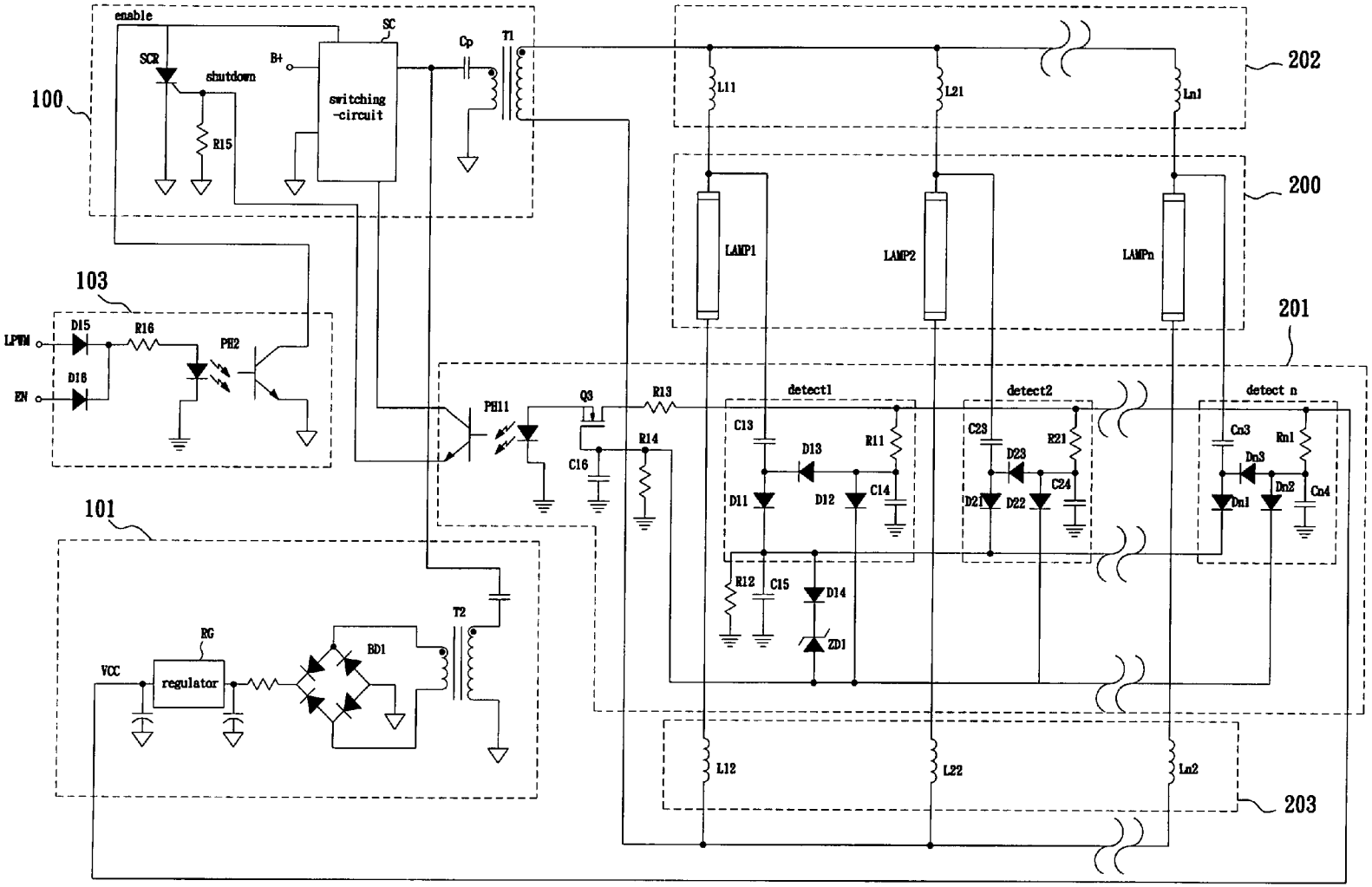
FIG. 5 illustrates a schematic view of an improved power supply circuit of a LCD panel in accordance with other preferred example of the present invention.

FIG. 5 illustrates schematic view of the improved power supply circuit of a LCD panel in accordance with other preferred example of the present invention. In the circuit of FIG. 5, the impedance matching device at positive end 202 and the impedance matching device at negative end 203 used for balance the current are replaced with inductors, L11-Ln1, L21-Ln2 to achieve the same effect of balancing current in the circuit. The inductors can produce resistant reaction higher than the CCFL during high frequency ($Z=j2\Pi fL$), the problem of unbalanced resistance at both ends of the CCFL can be improved.

Figure 6:
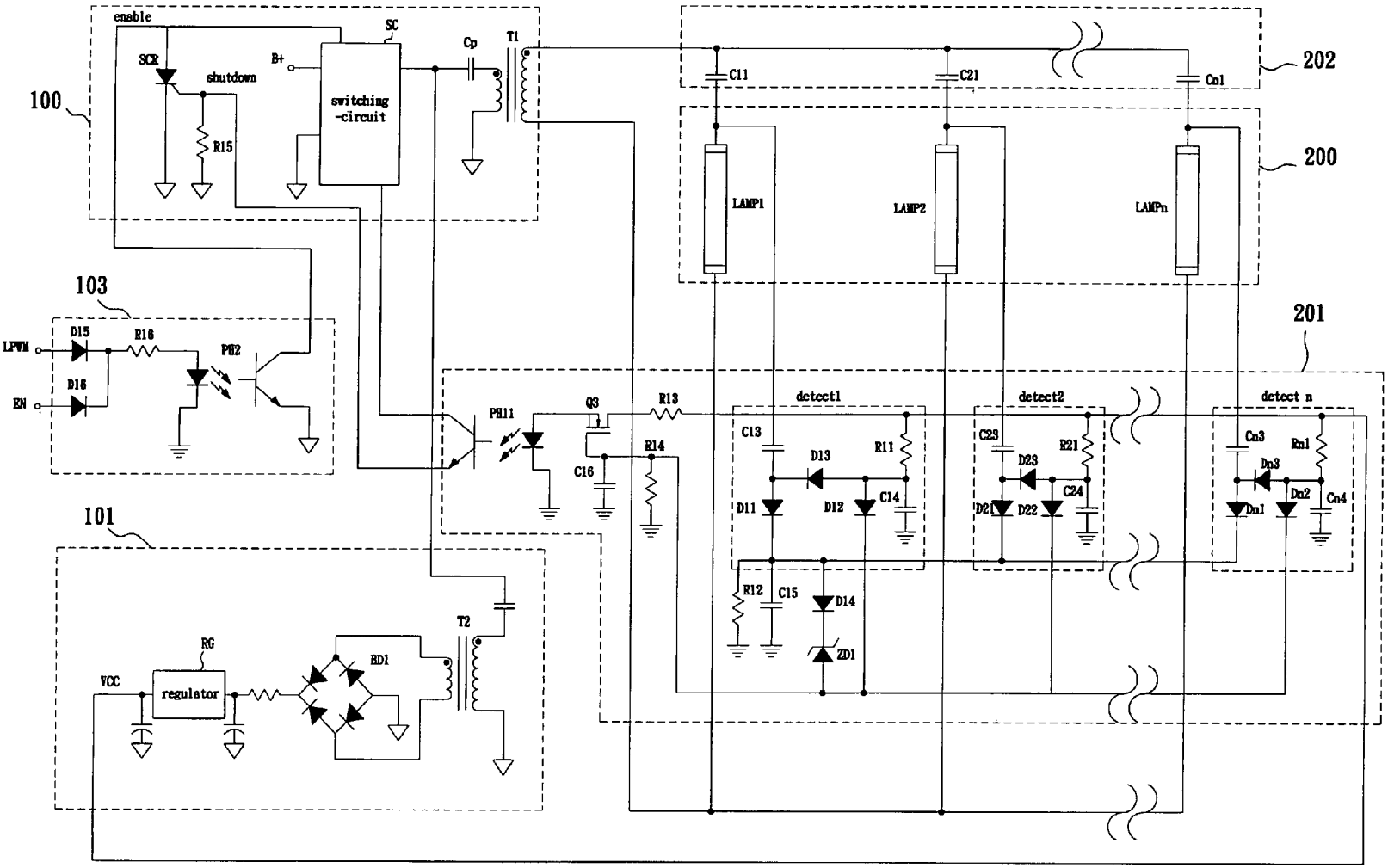
FIG. 6 is a schematic view of an improved power supply circuit of a LCD panel in accordance with other preferred example of the present invention.

FIG. 6 is schematic view of the improved power supply circuit of a LCD panel in accordance with other preferred example of the present invention. The circuit of FIG. 6 eliminates the impedance matching device at negative end 203 so that the size of its LCD board is much smaller. The smaller size of LCD board is, the shorter the lighting tube would be, and the less interference would be on the capacitor affected by a seal cover. As a result, the problem of unequal negative current is less serious. Therefore, the impedance matching device at negative end 203 used for balancing current can be eliminated from the circuit.

Referring back to FIG. 2, the CCFL abnormal detective circuit 201 utilizes the voltage detective capacitors C13-Cn3 connecting respectively to the anodes of every CCFL, LAMP1-LAMPn to determine whether there is abnormal voltage of every CCFL. In a normal condition, the voltage detective capacitors C13-Cn3 produce alternate current wave from the output of the transformer T1 to detect the normal voltage via the voltage divider of the diodes D11-Dn1 and a resistor R12. The normal voltage is then smoothly filtered through a filter capacitor C15 to produce direct voltage. Simultaneously, the voltage of the filter capacitor C15 is lower than the threshold voltage of the transistor Q3, the total voltage drop value of the diode D14 and the Zener diode ZD1. The normal voltage signal is sent to the negative end of the lighting diode of the optical coupler PHI. Delay capacitors, C14-Cn4, output via the transformer T1 a certain value of voltage that is charged through the resistors R11-Rn1 during the positive period. The voltage is controlled in a normal condition to lower than the threshold voltage of the transistor Q3, the total voltage drop value of the diode D14 and the Zener diode ZD1. The voltage detective capacitors C13-Cn3 discharge and reversed direction charge via the route of the diodes D13-Dn3 when the output of the transformer T1 is converted to negative direction alternate current wave.

The voltage of the delay capacitors C14 -Cn4 are discharged to a low voltage respectively via the diodes D13-Dn3. When any of the CCFL is failing to light up, the corresponding voltage detective capacitors C13-Cn3 will detect the higher voltage when the transformer T1 outputting positive direction alternate current wave. The voltage divider of the diodes D11-Dn1 and the resistor R12 is smoothing filtered through the capacitor C15 to produce direct current voltage. This voltage is higher than the threshold voltage of the transistor Q3, the total voltage drop value of the diode D14 and the Zener diode ZD1 in such that transistor Q3 is switched on and a abnormal voltage signal is produced and transferred to the negative end of the lighting diode of the optical coupler PH1. The transistor of the optical coupler is switched on so that the silicon control rectifier (SCR) of the switching electronic ballast circuit 100 can be switched on and off in order to stop the operations of the switching electronic ballast circuit 100. The power must be re-started to operate the switching electronic ballast circuit 100 normally.

The circuit of the present invention is specially designed to protect the circuit from any abnormal condition, such as any of the lamps, LAMP1-LAMPn of the CCFL group 200, occurring abnormal condition, for example, the short-circuit problem. One end of the voltage detective capacitors C13-Cn3 is connected to the zero voltage of the seal cover so that the delay capacitor C14-Cn4 within the abnormal detective units, detect1-detectn, of every lamp will continuously being charged and will not have a discharge period. The voltage of the delay capacitor C14-Cn4 will raise above the value of the threshold voltage of the transistor Q3, the total voltage drop value of the diode D14 and the Zener diode ZD1. The abnormal detective circuit 201 outputs an abnormal voltage signal via the optical coupler PH1 to the switching electronic ballast circuit 100 to allow the silicon control rectifier (SCR) of the switching electronic ballast circuit 100 can be switched on and off such that the operations of the switching electronic ballast circuit 100 can be stopped. The power must be re-started to operate the switching electronic ballast circuit 100 normally.

FIG. 2, the impedance matching device at positive end 202 and the impedance matching device at negative end 203 are provided in the circuit, small capacitors C11-Cn1, C21-Cn2 are connected respectively to anode and positive ends of every lamp LAMP1-LAMPn in series. The small capacitors can produce an impedance ($Z=1/j2\pi fC$) higher than the CCFL during high frequency, the problem of unbalanced resistance at both ends of the CCFL can be ignored and the condition of unbalancing current of lamp can be improved. The impedance matching device at negative end 203 used for balancing current is suitable for the large size of LCD panel, so that the problem of negative current unbalance can be improved. More particularly, the long length tube are with the different leakage capacitances between every lamp and seal cover resulting the unbalancing current between every CCFL.

Referring to FIG. 2, the adjustable lighting controlling portion and enabling control device 103 is utilized the low pulse wave modulation signal LPWM to control the operating period of the switching electronic ballast circuit 100 so that the lighting of the lamps can be controlled to provide corresponding brightness on the screen under various environmental conditions. The low pulse wave modulation LPWM signal is outputted to adjusting and enabling control device 103 to control the operating period of the switching electronic ballast circuit 100 via the function of the optical coupler PH2. When the low frequency pulse wave modulation LPWM signal is on a high voltage state, the optical coupler PH2 is switched on via the diode D15 to stop the operation of the switching electronic ballast circuit 100. When the low frequency pulse wave modulation LPWM signal is on a low voltage state, the optical coupler PH2 is switched off and the operation of the switching electronic ballast circuit 100 is continuously operating. The control portion of the adjusting and enabling control device 103 utilizes the enable signal (EN) of direct current voltage to control operation orders of the switching electronic ballast circuit 100. When direct current voltage unit is on a high voltage state, the optical coupler PH2 will be switched on through diode D16 to stop the operation of the switching electronic ballast circuit 100. When direct current voltage unit is on a low voltage state, the optical coupler PH2 will be switched off to allow the switching electronic ballast circuit 100 to operate.

With the invention has been described by way of example and in terms of a preferred example embodiment, it is to be understood that the invention is not limited thereto. To the contrary, it is intended to cover various modifications and similar arrangements and procedures, and the scope of the appended claims therefore should be accorded the broadest interpretation so as to encompass all such modifications and similar arrangements and procedures.

What is claimed is:

1. A power supply device for a backlight control of the LCD panel, capable of driving a plurality of cold cathode fluorescence lamps (CCFL), comprising:

a switching electronic ballast circuit, utilizing a primary sine wave voltage produced by a switching modulation circuit, wherein the primary sine wave voltage is transferred via a transformer to output a secondary sine wave voltage;

an impedance matching device at positive end, installed in between positive ends of the plurality of cold cathode fluorescence lamps and a positive end of a secondary winding of the transformer in order to balance the CCFL current;

a CCFL abnormal detective circuit, providing a detective unit respectively for each of the plurality of CCFL, wherein the detective unit comprises a voltage detective capacitor and a delay capacitor, every voltage detective capacitor is connected to a positive end of the corresponding CCFL to determine a positive end voltage, one end of the delay capacitor is connected to ground so that it can be charged or discharged through the positive end voltage, a first optical coupler of the CCFL abnormal detective circuit outputs a detective signal according to the positive end voltage to switch on or off the switching electronic ballast circuit;

an adjusting and enabling control device, producing and outputting an enabling signal to the switching electronic ballast circuit according to a low frequency signal for adjusting pulse wave width in order to control the operation timing of the switching electronic ballast circuit; and an auxiliary power source circuit, providing a stable direct current voltage to the CCFL abnormal detective circuit.

2. The power supply device of claim 1, wherein a transistor of the CCFL abnormal detective circuit controls the first optical coupler to output the detective signal, wherein the gate of the transistor is connected to every voltage detective capacitor via a Zener diode and at least one diode.

3. The power supply device of claim 1, wherein the auxiliary power source circuit utilizes the primary sine wave voltage to produce and provide the direct voltage to the CCFL abnormal detective circuit.

4. The power supply device of claim 1, wherein the auxiliary power source circuit can be any direct current power source circuit.

5. The power supply device of claim 1, wherein a diode provided in between the voltage detective capacitor and the delay capacitor can be replaced by a bipolar transistor.

6. The power supply device of claim 1, wherein the impedance matching device at positive end can comprise capacitors or inductors.

7. The power supply device of claim 1, wherein an impedance matching device at negative end is installed for balancing current in between a negative end of the secondary winding of the transformer and a negative end of each of the plurality of the CCFL.

8. The power supply device of claim 6, wherein the impedance matching device at negative end can comprise inductors or capacitors.

* * * * *